US008698033B2

(12) United States Patent
Ozil et al.

(10) Patent No.: US 8,698,033 B2
(45) Date of Patent: Apr. 15, 2014

(54) INTERRUPTING CHAMBER WITH A FIELD DISTRIBUTOR CYLINDER FOR HIGH-VOLTAGE OR MEDIUM-VOLTAGE CIRCUIT BREAKERS

(75) Inventors: Joël Ozil, St Andre de Corcy (FR); Christophe Creusot, Miribel (FR); Jean-Luc Bourgeois, Lyons (FR); Yannick Kieffel, Saint Jean de Bournay (FR)

(73) Assignee: Alstom Technology Ltd, Paris (FR)

( * ) Notice: Subject to any disclaimer, the term of this patent is extended or adjusted under 35 U.S.C. 154(b) by 615 days.

(21) Appl. No.: 12/443,920

(22) PCT Filed: Oct. 8, 2007

(86) PCT No.: PCT/EP2007/060626

§ 371 (c)(1),
(2), (4) Date: Oct. 12, 2009

(87) PCT Pub. No.: WO2008/043721

PCT Pub. Date: Apr. 17, 2008

(65) Prior Publication Data

US 2010/0032411 A1 Feb. 11, 2010

(30) Foreign Application Priority Data

Oct. 9, 2006 (FR) ..... 06 54160

(51) Int. Cl.
*H01H 33/70* (2006.01)

(52) U.S. Cl.
USPC ..... 218/53; 218/63

(58) Field of Classification Search
CPC ..... H01H 33/00; H01H 33/94; H01H 33/88; H01H 33/873
USPC ..... 218/11–14, 43, 45–57, 59–68, 72–77, 218/79, 80
See application file for complete search history.

(56) References Cited

U.S. PATENT DOCUMENTS

| | | | |
|---|---|---|---|
| 4,973,806 | A | 11/1990 | Kirchesch et al. |
| 5,231,256 | A | 7/1993 | Yamagiwa et al. |
| 5,478,980 | A | 12/1995 | Freeman et al. |

(Continued)

FOREIGN PATENT DOCUMENTS

| | | | |
|---|---|---|---|
| CA | 2154939 | A1 | 2/1996 |
| DE | 3904147 | A1 | 8/1990 |

(Continued)

OTHER PUBLICATIONS

PCT Search Report.

(Continued)

*Primary Examiner* — Amy Cohen Johnson
*Assistant Examiner* — Marina Fishman
(74) *Attorney, Agent, or Firm* — Pearne & Gordon LLP

(57) ABSTRACT

An insulating tube (18) located between the main contacts (12*b*, 14*b*) and the arcing contacts (12*a*, 14*a*) of an interrupting chamber (10) of a high-voltage or medium-voltage circuit-breaker makes it possible to modify the distribution of the equipotential lines (V) during breaking. Thus, it is possible to reduce the electric field on the contacts, and thus to improve the breaking and the dielectric strength in the open position. The insulating tube (18) can also serve for transmitting movement between the contacts (12, 14) for triggering the circuit-breaker.

21 Claims, 2 Drawing Sheets

(56) References Cited

U.S. PATENT DOCUMENTS

| | | | | |
|---|---|---|---|---|
| 5,578,806 | A | 11/1996 | Hofbauer et al. | |
| 5,654,532 | A | 8/1997 | Meyer et al. | |
| 5,850,065 | A | 12/1998 | Yaginuma et al. | |
| 5,905,243 | A | 5/1999 | Zehnder et al. | |
| 6,049,050 | A | 4/2000 | David | |
| 6,462,295 | B1 * | 10/2002 | Knobloch et al. | 218/48 |
| 6,495,785 | B1 | 12/2002 | Meyer | |

FOREIGN PATENT DOCUMENTS

| | | | |
|---|---|---|---|
| DE | 295 11 842 | U1 | 11/1996 |
| DE | 29511842 | U1 | 11/1996 |
| DE | 19641550 | A1 | 4/1998 |
| DE | 199 02 835 | A1 | 8/2000 |
| DE | 10345657 | A1 | 4/2005 |
| EP | 0313813 | A1 | 5/1989 |
| EP | 0 468 294 | A2 | 1/1992 |
| EP | 0513945 | A1 | 11/1992 |
| EP | 0313813 | B1 | 9/1993 |
| EP | 0 696 040 | A1 | 2/1996 |
| EP | 0696040 | A1 | 2/1996 |
| EP | 0 809 269 | A2 | 11/1997 |
| EP | 0809269 | A2 | 11/1997 |
| EP | 0 822 565 | A2 | 2/1998 |
| EP | 0822565 | A2 | 2/1998 |
| EP | 0 836 209 | A2 | 4/1998 |
| EP | 0836209 | A2 | 4/1998 |
| FR | 2 774 503 | A1 | 2/1998 |
| GB | 1 022 292 | A | 3/1966 |

OTHER PUBLICATIONS

French Search Report.

International Search Report for PCT/EP2007/060626.

Notice of Opposition in European Patent No. EP 2 076 914 B1; Dated Jan. 4, 2013.

* cited by examiner

INTERRUPTING CHAMBER WITH A FIELD DISTRIBUTOR CYLINDER FOR HIGH-VOLTAGE OR MEDIUM-VOLTAGE CIRCUIT BREAKERS

TECHNICAL FIELD

The present invention relates to circuit-breakers for high-voltage or medium-voltage, in which the opening distance between the contacts is reduced and breaking is improved.

More particularly, the invention relates to the presence of an insulating tube making it possible to distribute the electric field more uniformly during breaking, and to reduce the gradients exerted on the arcing contacts.

The cylinder can also be used for actuating the contacts by transmitting forces in opposite directions in order to reduce the drive energy and/or in order to enable the arcing contact and the main contact of the same contact set to be moved separately.

STATE OF THE PRIOR ART

An item of switchgear for medium voltage and high voltage has a pair of contacts mounted to move relative to each other between a closed position in which the electric current can flow and an open position in which the electric current is interrupted.

By convention, the term "main contact" is used to designate an electrical contact (with its anti-corona cap) via which the rated current passes; the main contact is associated with an "arcing contact" which performs the function of breaking proper. The term "moving contact" is used to designate the main and arcing contact assembly that is connected directly to the drive member.

The speed of separation of the contacts is one of the main parameters for guaranteeing the dielectric performance of the circuit-breaker on opening. In order to reduce the drive energy required while also increasing the speed of separation of the contacts, in particular during breaking performed by a circuit-breaker, it has been proposed to design two moving contacts that are mounted to move relative to each other and that are actuated via a single drive member. The "oppositely moving contact", also made up of a main contact and of an arcing contact, is then moved via a linkage, which is itself connected to the moving contact.

In particular, Document EP 0 822 565 describes a circuit-breaker for high voltage and medium voltage that has a lever having two arms, one arm being connected to a nozzle secured to or integral with a first contact and the other arm being connected to a second contact, that lever making it possible for the movement of the first contact to drive the second contact simultaneously in the opposite direction. Instead of a two-arm lever system, the system for transmitting the drive in a different direction can be implemented by a belt or chain looped around two pinions: see document FR 2 774 503.

The opening distance between the contacts remains large, however, due to the electric field present between the contacts during breaking, and due to the high voltages to be withstood while in the open position (e.g. due to surges while other switchgear is operating).

In order to reduce the electric field on the arcing contacts, it has been proposed, in a circuit-breaker with contacts moving in opposite directions, to position a short-stroke moving metal field electrode, with movement being driven by means of a two-arm lever: see document EP 0 809 269. Unfortunately, that solution modifies the field lines only on the same side as the oppositely moving arcing contact and at the end of the chamber opening stroke, and it is not adapted for all circuit-breaker configurations. Document DE 199 02 835 discloses only a partial solution of modification of field lines at the end of the opening stroke and only at the arcing contact rod.

SUMMARY OF THE INVENTION

Among other advantages, the invention proposes to overcome the above-described drawbacks, and distributing the electric field better at the contacts. This effect is obtained by putting in place an insulating tube which, by means of its dielectric properties, optimizes the equipotential lines throughout opening of the contacts and, in addition, can make it possible to obtain a double actuation system for actuating the contacts in opposite directions and to protect the main contacts effectively from the hot gazes generated by the breaking.

In one of its aspects, the invention provides an interrupting chamber for a high-voltage or medium-voltage circuit-breaker, said interrupting chamber containing two contacts, each of which is made up, in particular, of a "main" contact and of an "arcing" contact. The contacts are mounted to move relative to each other between an open position of the interrupting chamber and a closed position, actuation means making it possible for a moving contact to be moved. The other contact can be stationary, or else both contacts can be mounted to move in translation in opposite directions, in which case they are preferably moved by the same actuation means; it is also possible to provide sliding between the main contact and the arcing contact of the oppositely moving second contact.

The interrupting chamber of the invention is also provided with an insulating tube located between the main contacts and the stationary contacts, regardless of whether they are open or closed. According to the invention, the first contact is associated with a blowing nozzle located also in the insulating tube, and the interrupting chamber is filled with dielectric gas. Preferably, the insulating tube is fastened to the moving first main contact and it is guided in translation in the second main contact (which is a stationary contact or an oppositely moving contact), e.g. via a ring; the guide system can be gastight, thereby making it possible to avoid backflow of hot gases at the nozzle outlet towards the main contacts.

The insulating tube makes it possible to displace the equipotential lines so as to reduce the electric field applied to the contacts during breaking. It can be made of various materials, and in particular it can comprise arrangements of fibers, e.g. windings, in a resin; the material of the tube can also be filled, at its surface or through its thickness. In order to modulate the distribution of the field, the insulating tube can be provided with protuberances and/or portions of extra thickness, in particular at its ends, in particular at the arcing contact in the form of a rod. It is possible also to associate therewith a metal field electrode in order to reduce the gradient further.

Advantageously, the first contact is associated with a blast nozzle which is also located inside the insulating tube, and the interrupting chamber is filled with dielectric gas.

In a preferred embodiment, the two contacts are moving contacts and they are actuated via the insulating tube. The tube is then connected to a contact and to the actuating means so that the triggering of the circuit-breaker and the subsequent movement of the contact drive the actuation means. The actuation means are also connected via connection means to the second contact, so that movement of the tube in one direction drives the second contact in the opposite direction.

Preferably, the actuation means are in the form of a lever mounted to pivot about an axis. The connection means can be rigid rods and links connected to the lever arms, and the dimensioning of the lever arms can be adjusted to optimize the speed ratio between the first and the second contacts, or even between the main contact and the arcing contact of the same moving contact.

In another aspect, the invention provides a high-voltage or medium-voltage circuit-breaker provided with an interrupting chamber having a field distributor insulating tube that can, in addition, participate in actuating the contacts.

BRIEF DESCRIPTION OF THE DRAWINGS

The characteristics and advantages of the invention can be better understood on reading the following description and on examining the accompanying drawings which are given merely by way of non-limiting illustration, and in which.

DETAILED DESCRIPTION OF PARTICULAR EMBODIMENTS

Figure 1:
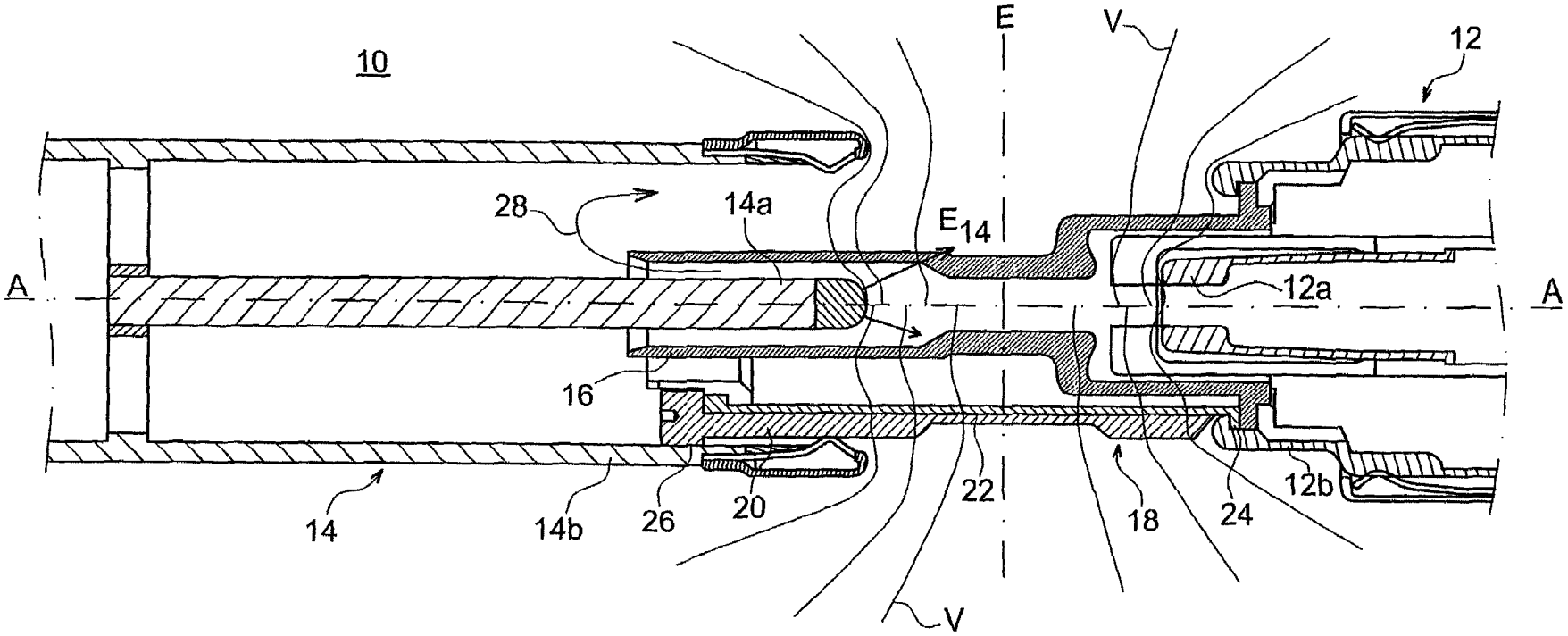
FIG. 1 is a diagram of an interrupting chamber, its top half showing a prior art chamber, and its bottom half showing an embodiment of an interrupting chamber of the invention.

A high-voltage or medium-voltage circuit-breaker as shown in the top portion of FIG. 1, includes an interrupting chamber 10 which can be filled with a dielectric gas of the sulfur hexafluoride ($SF_6$) type. The interrupting chamber 10 contains a moving first contact 12 made up of an arcing contact 12*a*, e.g. in the form of a thimble of fingers, and of a main contact 12*b*, and a second contact 14 that is stationary in this example, made up of an arcing contact 14*a*, in the form of a rod in this example, and of a main contact 14*b*. These two elements co-operate between an open position in which the two contacts 12, 14 are separated from each other and a closed position (not shown) in which they allow electrical current to pass between them.

During the breaking procedure, the two main contacts 12*b*, 14*b* separate, and then the arcing contacts 12*a*, 14*a* separate, after a latency period, if any, generated by the length of the mutual engagement, forming an electric arc that is extinguished by the contact 12 subsequently being moved further away.

The first contact 12 is usually secured to a nozzle 16 which is made of an insulating material and which itself extends a gas compression volume. This dielectric nozzle 16 serves as a blast nozzle for blasting the gas coming from the compression volume towards the electric arc.

As shown diagrammatically in the top portion of FIG. 1, while the contacts are separating, lines V of electric field E appear. The electric field E is very high, in particular on the arcing contact 14*a* due to its rod shape. Thus, the opening distance between the contacts must be sufficient to prevent arcs from re-striking.

In the invention, in order to improve breaking, in order to reduce the field E on the arcing contact rod 14*a*, and thus in order to reduce the opening distance, an insulating cylinder 18 is positioned at the contacts 12*a*, 14*a* in order to distribute the equipotential lines V differently, as shown in the bottom portion of FIG. 1. The cylinder 18 is positioned between the main contacts 12*b*, 14*b* and the arcing contacts 12*a*, 14*a*, regardless of whether the contacts 12, 14 are in the open position or in the closed position.

The presence of a tube 18 made of a material having a high relative permittivity acts on the field lines E, which are offset relative to their conventional positions. The field E on the arcing rod 14*b* is then reduced.

Figure 2A:
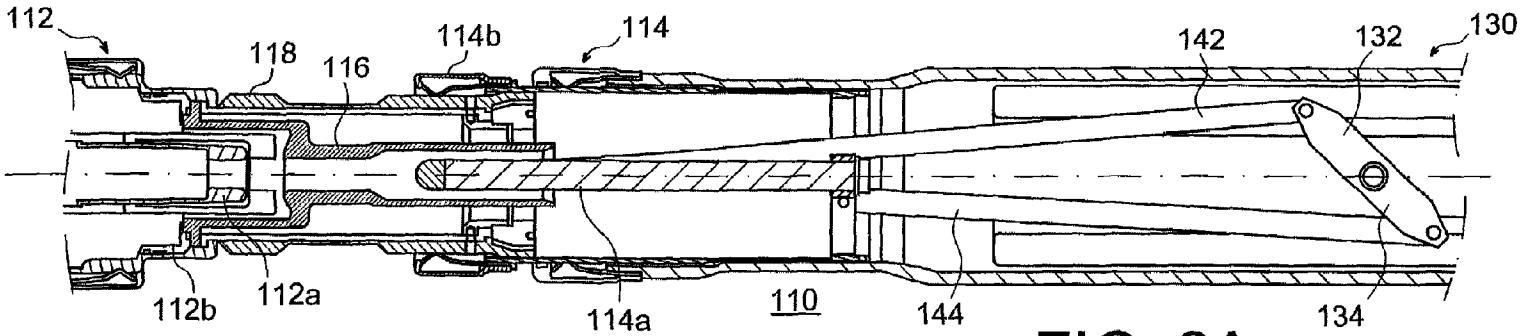
FIGS. 2A and 2B show a preferred embodiment of an interrupting chamber of the invention, seen from two different angular positions about its axis.
Figure 2B:
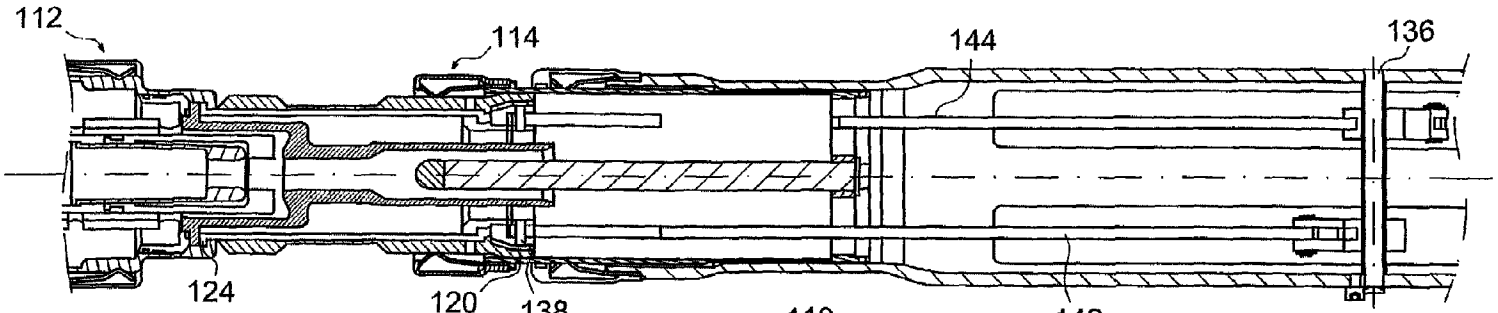

The insulating tube 18, 118 is a right cylinder which is interiorly hollow (see FIG. 1, FIGS. 2A and 2B) and which does not constitute a insulating duct or nozzle already known in interrupting chambers according to the state of the art. The insulating nozzle 16, 116 achieves a partial function of repartition of the electrical field as usually in the known interrupting chambers, whereas the insulating tube 18 according to the invention brings a supplementary modification of equipotential lines of the electrical field. Thus, the insulating tube 18, 118 has dielectrical properties which optimize the equipotential lines during all the opening of contacts 12*a*, 12*b*, 14*a*, 14*b* and whose arrangement allows to obtain this effect at all the contacts.

It is possible to choose the shape and the local thickness of the tube 18 in a manner such as to modulate its influence. In particular, if the thickness of the tube 18 increases at the arcing contact rod 14*a*, e.g. by the presence of a portion of extra thickness 20 at one end of the tube 18, the effect of modifying the field lines E is increased, and the field $E_{14}$ on said rod 14*a* is reduced correspondingly. Similarly, the relative permittivity of the tube 18 acts directly on the distribution of the equipotential lines V.

In particular, the tube 18 can be a hollow cylinder made of a thermoplastic or thermosetting polymer. Among thermosetting polymers, mention can be made, in particular, of the families of unsaturated polyesters, or of phenolic resins, or of epoxy resins in reaction with acid anhydride setting agents, or of polybismaleides, or of vinylester resins; among thermoplastic polymers, mention can be made, in particular, of the families of thermoplastic polyesters, or of polyamides, or of polycarbonates, or of phenylene polyoxides, or of polysulfones, or sulfur polyphenylenes, or polyetherketones, or liquid-crystal polymers, or polyimides, or fluorine-containing polymers of the polytetrafluoroethylene (PTFE) type. It is also possible to use a blend or alloy of these materials.

The tube 18 can also be made of an arrangement of fibers, in particular inorganic fibers such as glass fibers or polyester fibers or aramid fibers of the Kevlar™ type, each of which fibers can be in the form of continuous filaments, long fibers (>3 millimeters (mm), short fibers (<3 mm), mats or woven fabrics. Alternatively or additionally, the tube can, locally or throughout, contain particular reinforcement (alumina, alumina trihydrate, calcium oxide, magnesium oxide MgO, silica, wollastonite, calcium carbonate, titanium oxide, compounds based on silicate such as montmorillonites, vermiculites, and kaolin) that are organic or inorganic.

In another embodiment, the hollow cylinder 18 is made up of filamentary windings, in which the angle given to the winding can be in the range 0° to 90° uniformly over the entire cylinder 18 or varying thereover (in which case it is possible to modify the mechanical properties of the cylinder locally). The entire assembly is then impregnated or is pre-impregnated with resin (the impregnation being performed in a vacuum or otherwise), e.g. with an epoxy resin of the following types: bisphenol A, bisphenol F, or cycloaliphatic. Various reinforcing materials can also be added, such as inorganic fibers such as glass fibers, or polyester fibers or aramid fibbers of the Kevlar™ type, each of which fibers can be in the form of continuous filaments, long fibers (>3 mm), short fibers (<3 mm), mats, or woven fabrics.

In order to protect the fibers from the polluted $SF_6$ and from the decomposition products of $SF_6$, a protective varnish, e.g. a polyester film, can be deposited on the inside wall and/or on the outside wall of the tube 18, e.g. in a coat that is about 30 micrometers (μm) thick, such as an aliphatic polyurethane.

Preferably, the material of the insulating tube 18 includes, more or less locally, at its surface, or through its thickness, injections of fillers which also make it possible to optimize the electric field distribution function. Thus, the cylinder 18 and its protuberances 20 can include bisphenol A, bisphenol F or cycloaliphatic epoxy resins with local injection of filler, e.g. of the zinc oxide or titanium oxide type, optimizing its electric field distribution function.

In addition, another material 22 can be overmolded onto the inside diameter and/or onto the outside diameter of the cylinder 18, or deposited in a thin layer on its inside diameter and/or on its outside diameter. The layer can be made of a mixture of polymers (thermoplastic or thermosetting) with incorporation of a filler (material that can have a high relative permittivity) of the following types: ZnO, $TiO_2$, or carbon black, the filler content by weight lying in the range 0.1% to 300%, over a thickness lying the range 10 μm to 5 mm.

In both cases (polymer cylinder or arrangement of fibers), the insulating tube 18 can have various geometrical shapes, and it can be cylindrical, and preferably circularly symmetrical about the axis AA of the interrupting chamber 10, or it can be conical, or even polygonal; as indicated above, local portions of extra thickness 20 make it possible to modulate the distribution of the equipotential lines V on the basis of predetermined criteria, e.g. by computation and/or modeling.

It is possible, instead of the portion of extra thickness 20 located at the arcing contact rod 14*a* or above it, to position a metal electrode around, or in, or even inside the wall of the insulating tube 18: such an electrode makes it possible to reduce further the gradients and the field $E_{14}$ on the rod 14*a* and to improve breaking. Naturally, the location of said field electrode is not limited to the end of the tube 18.

The insulating tube 18 can be coupled to the first contact 12, preferably at its main contact 12*b*, optionally in fixed manner, via its end 24.

In addition to its advantage as regards uniform distribution of the equipotential lines V, the presence of the insulating tube 18 also makes it possible to center the moving contact 12*b* while it is traveling over its stroke relative to the second contact 14: preferably a guide element 26 is located between the outside wall of the insulating tube 18 and the inside wall of the second main contact 14*b*. Since the tube 18 is coupled to the moving contact 12, the contact 12 and the nozzle 16 are guided along the axis AA while they are moving. The guide system 26 can be the surface geometrical shape, but it preferably comprises a continuous or split ring, of small thickness, made of an insulating material having a low coefficient of friction (e.g. PTFE filled or otherwise).

It should also be noted that the same end makes it possible to prevent the hot gases 28 coming from the nozzle 16 from returning: as can be seen in the top portion of FIG. 1, when breaking high currents, hot gases 28 can be sprayed to the vicinity of the main contacts 12*b*, 14*b*. The presence of such hot gases 28 can cause dielectric arcs to strike that are potentially destructive for the circuit-breaker: usual management of such hot gases 28 involves overdimensioning the circuit-breaker. By means of the invention, in particular when a guide system 26, which can then be gastight, is provided, the hot gases are confined to the tube 18, and arc re-strikes between the permanent contacts 12*b*, 14*b* are avoided, while preserving a compact structure for the interrupting chamber 10.

The solution of the invention can also be applied for an interrupting chamber 110 with contacts moving in opposite direction. As shown in FIG. 2, the overall geometrical configuration of the chamber 110 can be similar to the above-described geometrical configuration: two contacts 112, 114 and the nozzle 116 move along the main axis AA of the interrupting chamber 110, each of the two contacts 112, 114 comprises an arcing contact 112*a*, 114*a* and a permanent contact 112*b*, 114*b* between which an insulating tube 118 is situated; each element 110, 112, 114, 116, 118 is symmetrical about the axis AA.

In this example, each of the contacts 112, 114 is actuated away from or towards the other contact via a single actuation system 130; the moving contact 112 moving during triggering of the circuit-breaker drives the actuation system 130 which moves the oppositely moving contact 114.

Preferably, the oppositely moving contact 114 is driven via the tube 118: this option makes it possible to offer greater freedom in implementing the actuation means 130 in view of the particularly complex geometrical shapes of the contact members 112, 114 of a high-voltage or medium-voltage interrupting chamber 110; because of its diameter, the insulating tube 118, makes it possible to transmit a movement over a wide range of drive forces.

Although it then has an additional force transmission function, the tube 18 can remain of small thickness: since it is a cylindrical tube with continuous walls, the load is uniformly distributed, and moving the moving first contact 12 and driving the oppositely moving second cylinder 14 do not need the walls of the tube to be thick in order for them to be strong enough, e.g. the tube 18 can have walls of thickness in the range only a few millimeters to a few tens of millimeters.

For transmitting forces, the insulating tube 118 is fastened via one end 124 to the first main contact 112, e.g. via a link pin, and the actuation device 130 is preferably located at its other end, on the same side as the oppositely moving contact 114.

The actuation means 130 can take various forms known to the person skilled in the art. Advantageously, the actuation means 130 comprise a lever having two arms 132, 134 mounted to pivot about an axis 136. The first arm 132 is connected to the insulating tube 118 (and thus indirectly to the first contact 112), e.g. at an end protuberance 120. It thus moves in the direction opposite to the direction in which the second arm 134 connected to the second contact 114 and preferably to the main contact 114*b* thereof moves.

The connection between the tube 118 and the first arm 132 is preferably implemented by a rotary fastening, e.g. a pin 138, at the end of a first rigid rod 142 connected via a pivot to an end portion of the arm 132.

Similarly, a link, or a second rigid rod 114 pivotally connects an end portion of the second arm 134 to the main contact 114*b*.

Depending on the desired movement and depending on the preferred speed, the connection at the oppositely moving contact 114 can be situated at various distances from the axis AA of movement. Similarly, the arms 132, 134 of the lever can be of identical length or of different lengths. In one embodiment, the combined length of the two arms 132, 134 is at its maximum, i.e. of the order of the diameter of the insulating tube 18, in order to optimize the forces.

It is possible to provide slots for connecting the connection rods 142, 144 in particular at the lever 130, if a latency time is recommended between starting to move each of the two contacts 112, 114: e.g. the second connection rod 144 of the oppositely moving contact 114 can move over a certain distance by sliding in a slot (not shown) in the second arm 134 before starting to move in translation along the axis AA.

Similarly, it is possible for the arcing contact 114*a* and the main contact 114*b* of the oppositely moving contact 114 to be mounted to slide relative to each other, and thus for them to have different strokes and different speeds. The arcing contact 114*a* and the main contact 114*b* are then connected to the actuation system 130 via different links and via different levers (not shown).

In another embodiment, optionally in combination with the preceding embodiments, the axis 136 of the lever 130 is orthogonal to the axis AA of movement, so that the ends of the arms 132, 134 and thus the connection links 142, 144 move in a plane, thus making it possible for them to be subjected to less stress at their anchor points. Advantageously, for reasons of symmetry and of ease of assembly, the axis 136 of the lever intersects the axis AA of movement of the contacts 112, 114.

In order to improve the guiding of the moving cylinder 118, and in particular in order to reduce the radial forces to zero, in another embodiment, the actuation means 130 comprise two preferably axially symmetrical levers whose pivot axes coincide; each arm of each lever is connected via a rod to the tube 118 or to the second contact 114, preferably at two diametrically opposite points.

Other actuation or guide means can be devised. In accordance with the invention, by means of the presence of an insulating tube 18, 118 making it possible for the equipotential lines V to be distributed better, actuation design options are open and are easier to achieve. In addition, the overall radial size and the general mass to be actuated remain in the same proportions as in the state of the art, while the protection of the contacts during breaking of high currents is increased.

The invention claimed is:

1. An interrupting chamber for a high-voltage or medium-voltage circuit-breaker, said interrupting chamber containing at least:

a first contact comprising an arcing contact and a main contact mounted to move along the axis of the interrupting chamber;

a second contact comprising an arcing contact and a main contact;

actuation means making it possible to actuate the first contact so that it moves between a closed position in which the two contacts are in mutual contact and an open position in which they are separated;

a tube made of a high permittivity dielectric material, extending longitudinally along the axis and positioned so that, regardless of the relative position of the contacts, the two arcing contacts are located inside the tube and the two main contacts are located outside the tube; and a nozzle (16, 116) that is made of a high permittivity dielectric material, that is coupled in fixed manner to the first contact (12, 112), and the nozzle that is located inside the tube (18, 118), wherein the nozzle extends past contacting ends of the first arcing contact and the second arcing contact when the circuit breaker is in either an open or closed position, wherein the high permittivity dielectric material of the tube reduces the electric field on the contacts during breaking and in the open position.

2. An interrupting chamber according to claim 1, in which the insulating material of the tube comprises an arrangement of fibers, such as a filamentary winding.

3. An interrupting chamber according to claim 1, in which the insulating material of the tube comprises a resin that is filled through its thickness or at its surface.

4. An interrupting chamber according to claim 1, in which the insulating material of the tube is thermoplastic or thermosetting.

5. An insulating material according to claim 1, in which the insulating tube is provided with a portion of extra thickness at least one end thereof.

6. An interrupting chamber according to claim 1, further containing a metal tubular field electrode that is secured to one end of the insulating tube.

7. An interrupting chamber according to claim 1, in which the tube is coupled in fixed manner to the first contact via its end.

8. An interrupting chamber according to claim 7, further containing a mechanical guide system for guiding the insulating tube in translation along the main contact of the second contact.

9. An interrupting chamber according to claim 8, in which the guide system is gastight.

10. An interrupting chamber according to claim 1, in which the second contact is mounted to move along the axis and moves in a direction opposite to the direction in which the first contact moves.

11. An interrupting chamber according to claim 10, in which the actuation means of the first contact make it possible to actuate the second contact.

12. An interrupting chamber according to claim 11, containing first connection means secured to the tube and to the actuation means, and second connection means secured to the second contact and to the actuation means so that, when they are operated, the actuation means cause the tube and the second contact to move in translation in opposite directions.

13. An interrupting chamber according to claim 12, in which the connection means comprise a rod connected at one end to the tube or to the second contact, and at the other end to the actuation means.

14. An interrupting chamber according to claim 13, in which the second connection means comprise two rods secured to the actuation means and respectively to the main contact and to the arcing contact, so that the arcing contact and the main contact of the second contact slide relative to each other.

15. An interrupting chamber according to claim 12, in which the actuation means comprise a lever having two arms mounted to pivot about an axis, so that, when the lever pivots about its axis, the first and second contacts move in translation in opposite directions along the axis of the chamber.

16. A high-voltage or medium-voltage circuit-breaker including an interrupting chamber according to claim 1.

17. An interrupting chamber according to claim 1, wherein the tube is configured to have continuous walls without gaps.

18. An interrupting chamber according to claim 1, wherein the nozzle is spaced apart from the tube.

19. An interrupting chamber according to claim 1, wherein the tube is coupled to at least one of the first contact of the main contact or the second contact of the main contact in a fixed manner, wherein the tube guides the at least one of the first contact of the main contact or the second contact of the main contact during breaking.

20. An interrupting chamber according to claim 1, wherein the tube forms part of a gastight seal between the arcing contacts and the main contacts, and wherein the tube prevents a fluid connection between the arcing contacts and the main contacts during opening of the circuit-breaker.

21. An interrupting chamber according to claim 20, wherein the nozzle directs hot gases created by breaking of the first and second arcing contacts into an expansion area.

* * * * *

UNITED STATES PATENT AND TRADEMARK OFFICE

CERTIFICATE OF CORRECTION

PATENT NO. : 8,698,033 B2
APPLICATION NO. : 12/443920
DATED : April 15, 2014
INVENTOR(S) : Ozil et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 665 days.

Signed and Sealed this
Twenty-ninth Day of September, 2015

Michelle K. Lee

Michelle K. Lee
*Director of the United States Patent and Trademark Office*